US008061899B2

(12) United States Patent
Zimmerman et al.

(10) Patent No.: US 8,061,899 B2
(45) Date of Patent: Nov. 22, 2011

(54) STORAGE BAG

(75) Inventors: Dean A. Zimmerman, West Chester, OH (US); Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 1198 days.

(21) Appl. No.: 11/170,524

(22) Filed: Jun. 29, 2005

(65) Prior Publication Data

US 2006/0110079 A1 May 25, 2006

Related U.S. Application Data

(63) Continuation-in-part of application No. 10/880,784, filed on Jun. 29, 2004, now Pat. No. 7,726,880.

(51) Int. Cl.
*B65D 33/01* (2006.01)

(52) U.S. Cl. ..... 383/100; 383/101; 383/43

(58) Field of Classification Search ..... 383/63, 383/105, 100–103, 43–45; 220/661, 203.01, 220/203.11; 210/136; 206/829, 524.8
See application file for complete search history.

(56) References Cited

U.S. PATENT DOCUMENTS

| | | | | |
|---|---|---|---|---|
| 2,778,173 | A | 8/1951 | Taunton | |
| 2,576,322 | A | 11/1951 | Waters | |
| 2,778,171 | A | 1/1957 | Taunton | |
| 2,870,954 | A | 1/1959 | Kulesza | |
| 3,430,842 | A * | 3/1969 | Gennosuke | 383/45 |
| 3,468,471 | A * | 9/1969 | Linder | 206/439 |
| 3,980,226 | A | 9/1976 | Franz | |
| 4,197,100 | A * | 4/1980 | Hausheer | 55/382 |
| 4,215,725 | A * | 8/1980 | Callet et al. | 137/855 |
| 4,295,566 | A | 10/1981 | Vincek | |
| 4,310,118 | A * | 1/1982 | Kisida et al. | 383/103 |
| 4,702,376 | A | 10/1987 | Pagliaro | |
| 4,715,494 | A | 12/1987 | Heitzenrioder et al. | |
| 4,756,422 | A | 7/1988 | Kristen | |
| 5,228,271 | A | 7/1993 | Wallace | |
| 5,332,095 | A | 7/1994 | Wu | |
| 5,354,133 | A * | 10/1994 | Rapparini | 383/103 |
| RE34,929 | E | 5/1995 | Kristen | |
| 5,450,963 | A | 9/1995 | Carson | |
| 5,480,030 | A | 1/1996 | Sweeney et al. | |
| 5,515,994 | A * | 5/1996 | Goglio | 220/372 |
| 5,544,752 | A | 8/1996 | Cox | |
| 5,584,409 | A * | 12/1996 | Chemberlen | 383/103 |

(Continued)

FOREIGN PATENT DOCUMENTS

WO WO2004/002840 1/2004

(Continued)

*Primary Examiner* — Nathan J Newhouse
*Assistant Examiner* — Peter Helvey
(74) *Attorney, Agent, or Firm* — David Peterson

(57) ABSTRACT

A flexible storage bag for storing food items and the like is provided with a separation material positioned to cover an aperture disposed in and/or a one-way valve element attached to the storage bag. The separation material may be a non-woven material. When latent air remaining in the interior volume of the storage bag is exhausted through the aperture and/or one-way valve element, the air passes through the separation material. The separation material functions to remove liquids that may be entrained in the exhausting air. In an embodiment, the separation material may be treated with a low surface energy substance to improve the liquid removal function. In another embodiment, the separation material may be provided as a plurality of layers or as part of the one-way valve element.

13 Claims, 7 Drawing Sheets

U.S. PATENT DOCUMENTS

| | | | | |
|---|---|---|---|---|
| 5,782,266 | A * | 7/1998 | Domke | 383/103 |
| 5,881,881 | A | 3/1999 | Carrington | |
| 5,989,608 | A * | 11/1999 | Mizuno | 426/113 |
| 5,996,800 | A | 12/1999 | Pratt | |
| 6,021,624 | A | 2/2000 | Richison et al. | |
| 6,039,182 | A | 3/2000 | Light | |
| 6,056,439 | A * | 5/2000 | Graham | 383/103 |
| 6,059,457 | A | 5/2000 | Sprehe et al. | |
| 6,070,397 | A | 6/2000 | Bachhuber | |
| 6,070,728 | A * | 6/2000 | Overby et al. | 383/103 |
| 6,357,915 | B2 | 3/2002 | Anderson | |
| 6,378,272 | B1 * | 4/2002 | Archibald et al. | 53/412 |
| 6,575,191 | B2 | 6/2003 | Skeens et al. | |
| 6,581,641 | B2 | 6/2003 | Skeens et al. | |
| 6,604,634 | B2 | 8/2003 | Su | |
| 6,715,644 | B2 | 4/2004 | Wilford | |
| 6,799,680 | B2 | 10/2004 | Mak | |
| 6,932,509 | B2 | 8/2005 | Shah et al. | |
| 7,137,738 | B2 * | 11/2006 | Shah et al. | 383/103 |
| 2003/0024847 | A1 | 2/2003 | Malaspina | |
| 2003/0102245 | A1 | 6/2003 | Wang | |
| 2003/0155269 | A1 | 8/2003 | Lee | |
| 2004/0000501 | A1 | 1/2004 | Shah et al. | |
| 2004/0000502 | A1 | 1/2004 | Shah et al. | |
| 2004/0000503 | A1 | 1/2004 | Shah et al. | |
| 2004/0007494 | A1 | 1/2004 | Popeil et al. | |
| 2004/0050745 | A1 | 3/2004 | Lee et al. | |
| 2004/0238397 | A1 * | 12/2004 | Yu et al. | 383/103 |
| 2005/0025396 | A1 | 2/2005 | ErkenBrack | |
| 2005/0031229 | A1 * | 2/2005 | Tang | 383/103 |
| 2005/0036718 | A1 | 2/2005 | Wu et al. | |
| 2005/0065007 | A1 | 3/2005 | Wu et al. | |
| 2005/0172577 | A1 | 8/2005 | Oltrogge | |
| 2005/0205455 | A1 | 9/2005 | Harrison | |

FOREIGN PATENT DOCUMENTS

| | | |
|---|---|---|
| WO | WO2004/002841 | 1/2004 |
| WO | WO2004/002850 | 1/2004 |
| WO | WO 2005/000706 | 1/2005 |
| WO | WO 2005/016774 | 2/2005 |
| WO | WO 2005/040005 | 5/2005 |

* cited by examiner

FIG. 4
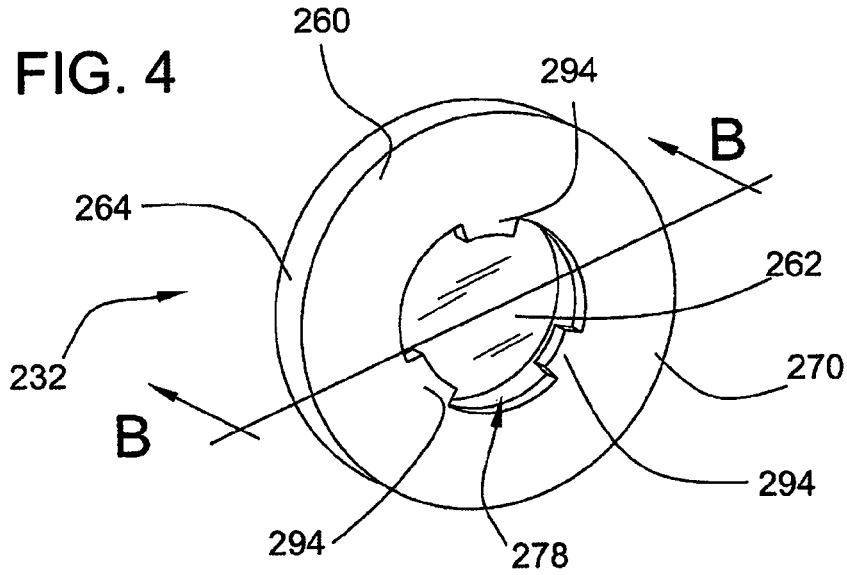
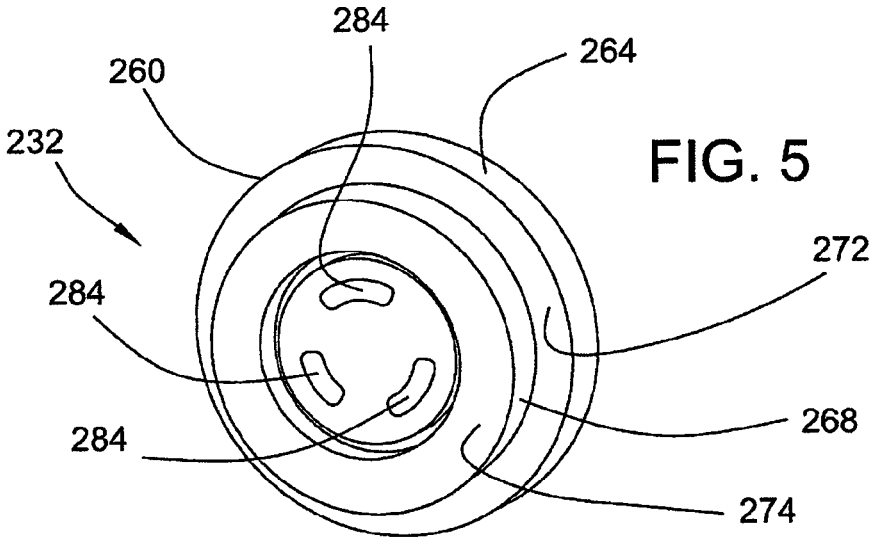
FIG. 5
FIG. 6
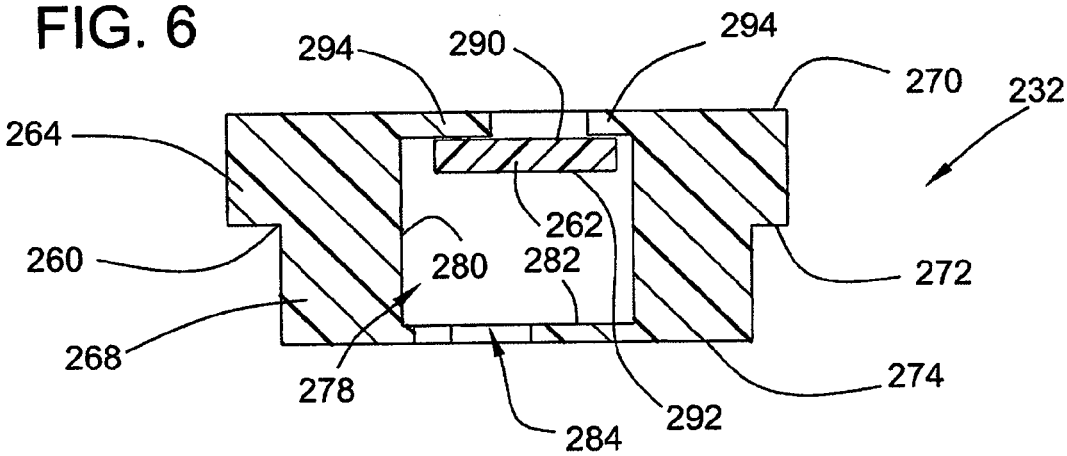

STORAGE BAG

CROSS-REFERENCE TO RELATED APPLICATIONS

This patent application is a continuation-in-part of U.S. patent application Ser. No. 10/880,784, filed Jun. 29, 2004 now U.S. Pat. No. 7,726,880.

FIELD OF THE INVENTION

This invention pertains generally to storage containers and more particularly to flexible and closable storage bags. The invention finds particular applicability in the field of food storage.

BACKGROUND OF THE INVENTION

Storage bags are commonly used for a variety of purposes such as storing food items. Such storage bags are typically made from a pliable, low cost, thermoplastic material that defines an interior volume into which food items can be inserted. To preserve the inserted food, the storage bag may also include a distinct closing mechanism, such as interlocking fastening strips, for sealing closed an opening through which the interior volume is accessible.

One problem that occurs with the aforementioned storage bags is that latent air may remain trapped within the interior volume after sealing closed the opening. The trapped air may cause spoiling or dehydration of the food items. To remove the trapped air, it is known to provide an aperture disposed through a sidewall of the storage bag that communicates with the interior volume. Latent air can be forced or drawn through the aperture by, for example, applying compressive pressure to the pliable sidewalls or by use of a distinct evacuation device such as a nozzle connected to a vacuum source. To prevent the ingress of the surrounding environmental air back through the aperture and into the interior volume, it is further known to provide a one-valve element that operates to control the flow of air through the aperture. The one-way valve element may be activated in various ways such as, for example, by applying compressive pressure to the flexible sidewalls to force air from the interior volume.

Often, the stored food items contain liquids or juices. During evacuation, the liquids may escape via the aperture or be drawn into and thereby contaminate the valve element. As will be appreciated, the contaminated valve element may result in sanitary issues and may not function properly. Moreover, the liquids or juices may also be drawn through the valve element and into the vacuum source or otherwise ejected into the environment, causing additional sanitary or operational problems. In addition to the sanitary issues, allowing liquids to escape from the interior volume can result in dehydration of enclosed food stuffs.

BRIEF SUMMARY OF THE INVENTION

The invention provides a storage bag configured to separate liquids and juices from air being evacuated from the interior volume via an aperture or a one-way valve element. To accomplish separation of liquids, the bag includes a separation material located so as to substantially cover the aperture and/or valve-element. The separation material may be a non-woven material. The non-woven material may demonstrate hydrophobic or hydrophilic characteristics to assist in separating liquids from the air. Moreover, in various aspects, the non-woven material can be treated with specific substances to improve those hydrophobic or hydrophilic characteristics or the material may be provided as a plurality of overlying layers. During evacuation, air from the interior volume passes through the non-woven material where liquids become retained or are otherwise repelled and returned back to the interior volume.

Thus, an advantage of the invention is that it helps retain liquids in a bag, which further prevents dehydration of enclosed food stuffs and contamination of the surrounding environment. Another advantage is that the invention prevents contamination of a one-way valve element communicating with the interior volume. These and other advantages and features of the invention will become apparent from the detailed description and the accompanying drawings.

BRIEF DESCRIPTION OF THE DRAWINGS

FIG. 4 is a front perspective view taken of an embodiment of a rigid one-way valve element to which the non-woven can be drawn over or attached.

FIG. 5 is a rear perspective view of the one-way valve element of FIG. 4.

FIG. 6 is a cross-sectional view through the one-way valve element taken along line B-B of FIG. 4.

DETAILED DESCRIPTION OF THE EMBODIMENTS

Figure 1:
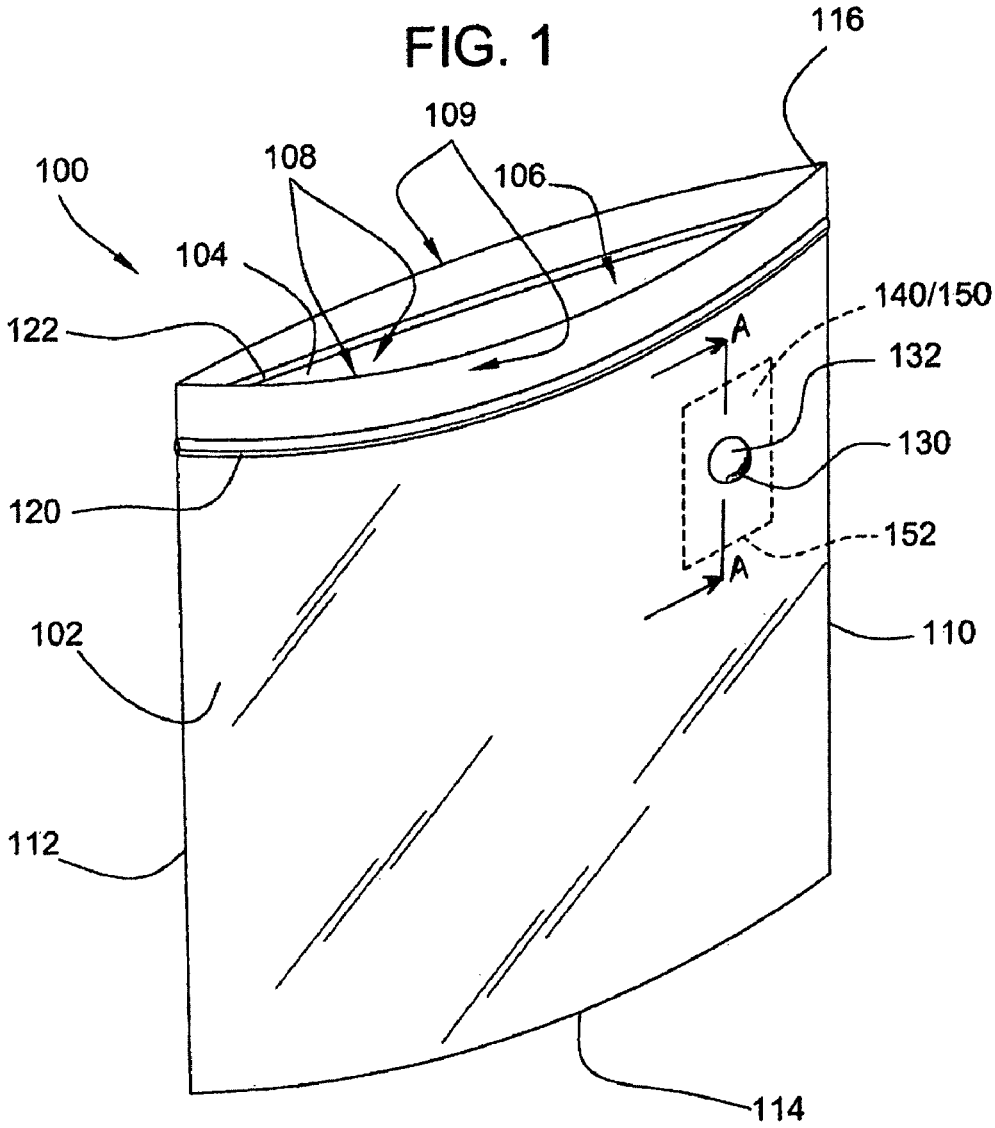
FIG. 1 is a front perspective view of a storage bag designed in accordance with the teachings of the invention incorporating a non-woven material covering an aperture and/or one-way valve element.

Now referring to the drawings, wherein like reference numbers refer to like features, there is illustrated in FIG. 1 a flexible storage bag 100 designed in accordance with the teachings of the invention. The storage bag 100 includes a first sidewall 102 and an opposing second sidewall 104 overlaying and joined to the first sidewall to provide an interior volume 106. Accordingly, with reference to the interior volume 106, it will be appreciated that each of the first and second sidewalls 102, 104 has an interior surface 108 and an exterior surface 109.

The first and second sidewalls can be made from webs of pliable thermoplastic material. Examples of suitable thermoplastic material include polyethylene (PE), high density polyethylene (HDPE), low density polyethylene (LDPE), linear low density polyethylene (LLDPE), polypropylene (PP), ethylene vinyl acetate (EVA), nylon, polyester, polyamide, ethylene vinyl alcohol, and can be formed in single or multiple layers. The thermoplastic material can be transparent, translucent, opaque, or tinted. Furthermore, the material used for the sidewalls can be a gas impermeable material.

The first and second sidewalls 102, 104 are joined together along a first side edge 110, a parallel second side edge 112, and a closed bottom edge 114 by, for example, a heat sealing operation. To access the interior volume 106, the portions of the first and second sidewalls 102, 104 along the top edges 116 remain un-joined to provide an opening. Due to the four orthogonal edges, the illustrated storage bag 100 has a rectangular shape. However, it will be appreciated in other embodiments that the bag can have any suitable shape resulting from any number of sidewalls and end.

To releasably close the opened top end 116 after insertion of an item for storage, there is attached to the first and second sidewalls 102, 104 parallel to the opened top end respective first and second fastening strips 120, 122. The first and second fastening strips 120, 122 can be formed from extruded, flexible thermoplastic material and extend between the first and second side edges 110, 112. As will be appreciated by those of skill in the art, the first and second fastening strips 120, 122 can engage to form a seal which closes the normally opened top end 116. In other embodiments or in combination with the interlocking fastening strips, other methods such as the use of pressure sensitive or cold seal adhesives, heat sealing, mechanical clamps and twist ties, or cling can be employed to close the opened top end.

To remove latent air from the storage bag 100 after closing the opened top end 116, there is disposed through the first sidewall 102 an aperture 130 that communicates with the interior volume 106. Air can be forced or drawn through the aperture 130 by, for instance, applying a compressive force against the sidewalls 102, 104 or by employing a distinct evacuation device such as a nozzle connected to a vacuum source. To prevent the ingress of environmental air back through the aperture 130, a closure element is provided, such as a one-way valve element 132 to operate in conjunction with the aperture. The one-way valve element 132 is capable of opening to allow entrapped air from the interior volume 106 to exit via the aperture 130 and of closing to block the aperture.

In accordance with the teachings of the invention, to prevent liquids and juices that may result from the stored items from exiting the interior volume through the aperture 130 and/or valve element 132, the storage bag 100 can include a separation material 140 that operates in conjunction with the aperture and/or valve element. In the illustrated embodiment, the separation material 140 can be provided as a non-woven material attached to the inner surface 108 of the first sidewall 102 such that the non-woven overlays and covers the aperture 130 and/or valve element 132. In this position, it will be appreciated that air exhausting from the interior volume 106 must encounter and pass through the non-woven material 140 to exit the storage bag 100 at which time the non-woven material will function to completely or partially remove or substantially separate liquids entrained in the exhausting air.

To accomplish this, the non-woven material 140 is sufficiently permeable to air while also demonstrating liquid resistant properties such as hydrophobic or hydrophilic characteristics to remove liquids. If the non-woven material demonstrates hydrophobic properties, liquids otherwise entrained in the exhausting air will be removed and returned to the interior volume by the non-woven material. If the non-woven material demonstrated hydrophilic characteristics, liquids entrained in the exhausting air will be absorbed and retained by the non-woven material. In one embodiment, the air permeability of the non-woven material is on the order about five cubic feet per minute while the hydrophobic or hydrophilic properties are such that the non-woven material can withstand a head pressure of about ten mbars.

To achieve the desired air permeability properties, in a first embodiment, the non-woven may be made from fine fibers on the order of 30 microns or less and in a second embodiment, 10 microns or less and in a third embodiment, on the order of between about 2 to 5 microns. Examples of non-woven materials include polypropylene, polyethylene, ethylene copolymers, nylon, or polyester and the non-woven material can be formed by any suitable operation including melt blown, spun bond, hydroentangled, needle punched, batting, dry-laid or wet-laid.

To achieve the desired liquid resistant or retentive properties, it may be advantageous to treat the non-woven material with a low surface energy substance. Examples of such low surface energy substances include those containing fluorine or silicon such as fluoroelastomers, fluoropolymers, flourinated fluids, or silicones such as polydimethylsiloxane. Treatment can be accomplished in any suitable way including, for example, coating the non-woven material with the liquid low energy substance, or by incorporating or impregnating the low energy substance into the fibers of the non-woven material. In those embodiments in which the non-woven material is treated by coating, the low surface energy substance can be applied to one or more surfaces of the non-woven material.

Figure 2:
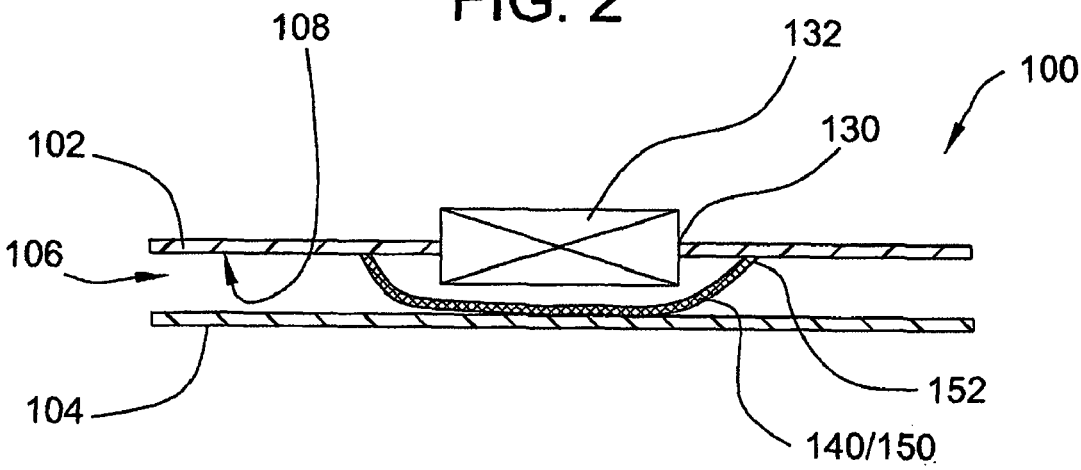
FIG. 2 is a cross-sectional view taken along line A-A of FIG. 1 showing the non-woven material loosely drawn over a valve element.

The non-woven material may have any suitable shape and can be attached to the storage bag to cover the aperture and/or valve element in any of various suitable methods. For example, referring to FIGS. 1 and 2, the non-woven material 140 is provided as a rectangular sheet 150 that is attached to the inner surface 108 of the first sidewall 102 continuously about its peripheral edge 152. Attaching of the non-woven sheet 150 to the inner surface 108 can be accomplished, for example, by use of adhesives or by heat-sealing. In the illustrated embodiment, the non-woven sheet 150 is sized and attached such that the sheet is drawn loosely over the aperture 130 and/or valve element 132. Hence, the non-woven sheet 150 can move with respect to and even drop and hang away from the aperture 130 and/or valve element 132. However, in other embodiments, the non-woven material can be tightly or snuggly drawn over the aperture and/or valve element. In the embodiments in which the non-woven material is treated by applying a coating of a low surface tension substance, the coating may be on the surface of the non-woven sheet directed toward the interior volume, the surface directed toward the aperture and/or valve element, or both surfaces.

Figure 3:
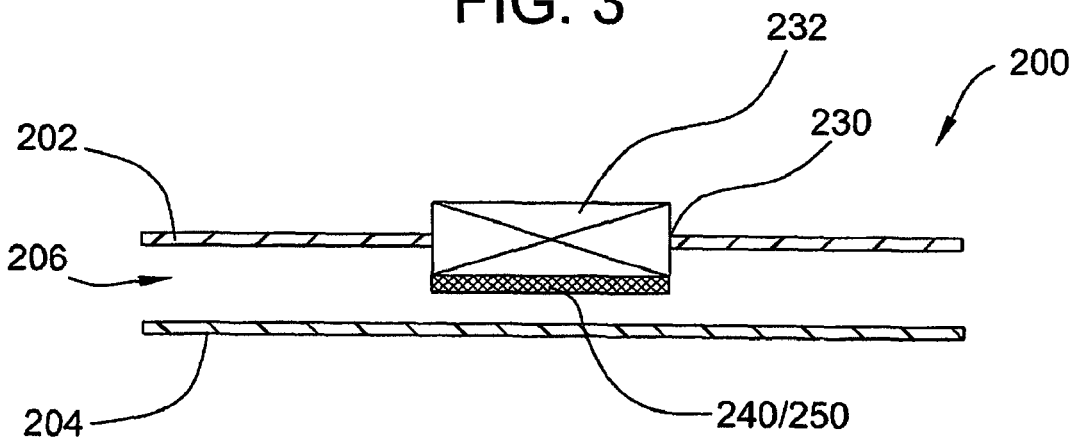
FIG. 3 is a cross-sectional view taken along line A-A of FIG. 1 showing the non-woven material directly attached to a rigid one-way valve element.

Another embodiment of a storage bag 200 having first and second side walls designated by reference numerals 202 and 204, respectively, and a separation material 240 for separating liquids from exhausting air is illustrated in FIG. 3. The separation material may be a non-woven material. The non-woven material 240 is provided as a pad 250 that can be directly attached to a rigid one-way valve element 232 which in turn is attached to the first side wall 202 to operate in conjunction with the aperture 230. In the illustrated embodiment, the non-woven pad 250 is attached to the portion of the valve element 232 that accesses the interior volume 206 so that exhausting air from the interior volume must pass through the non-woven pad prior to entering the valve element.

Referring to FIGS. 4, 5, and 6, in an embodiment the rigid one-way valve element 232 for use with a storage bag and separation material in the aforementioned fashion can include a rigid valve body 260 that cooperates with a movable disk 262 to open and close the valve element. The valve body 260 includes a circular flange portion 264 extending between parallel first and second flange faces 270, 272. Concentric to the flange portion 264 and projecting from the second flange face 272 is a circular boss portion 268 which terminates in a planar boss face 274 that is parallel to the first and second flange faces. The circular boss portion 268 is smaller in diameter than the flange portion 264 so that the outermost annular rim of the second flange face 272 remains exposed. The valve body 260 can be made from any suitable material such as a moldable thermoplastic material like nylon, high density polyethylene (HDPE), high impact polystyrene (HIPS), polycarbonates (PC), and the like.

Disposed concentrically into the valve body 260 is a counter-bore 278. The counter-bore 278 extends from the first flange face 270 part way towards the boss face 274. The counter-bore 278 defines a cylindrical bore wall 280. Because it extends only part way toward the boss face 274, the counter-bore 278 forms within the valve body 260 a preferably planar valve seat 282. To establish fluid communication across the valve body 260, there is disposed through the valve seat 282 at least one aperture 284. In fact, in the illustrated embodiment, a plurality of apertures 284 are arranged concentrically and spaced inwardly from the cylindrical bore wall 280.

To cooperatively accommodate the movable disk 262, the disk is inserted into the counter-bore 278. Accordingly, the disk 262 is preferably smaller in diameter than the counter-bore 278 and has a thickness as measured between a first disk face 290 and a second disk face 292 that is substantially less than the length of the counter-bore 278 between the first flange face 270 and the valve seat 282. To retain the disk 262 within the counter-bore 278, there is formed proximate to the first flange face 270 a plurality of radially inward extending fingers 294. The disk 262 can be made from any suitable material such as, for example, a resilient elastomer.

Referring to FIG. 6, when the disk 262 within the counter-bore 278 is moved adjacent to the fingers 294, the valve element 232 is in its open configuration allowing air to communicate between the first flange face 270 and the boss face 274. However, when the disk 262 is adjacent the valve seat 282 thereby covering the apertures 284, the valve element 232 is in its closed configuration. To assist in sealing the disk 262 over the apertures 284, a sealing liquid can be applied to the valve seat 282. Furthermore, a foam or other resilient member may be placed in the counter-bore 278 to provide a tight fit of the disk 262 and the valve seat 282 in the closed position.

To attach the valve element 232 to the first sidewall, referring to FIG. 5, an adhesive can be applied to the exposed annular rim portion of the second flange face 272. The valve element 232 can then be placed adjacent the exterior surface of the first sidewall with the boss portion 268 being received through the aperture disposed into the sidewall and thereby pass into the interior volume. Of course, in other embodiments, adhesive can be placed on other portions of the valve element, such as the first flange face, prior to attachment to the sidewall.

Figure 7:
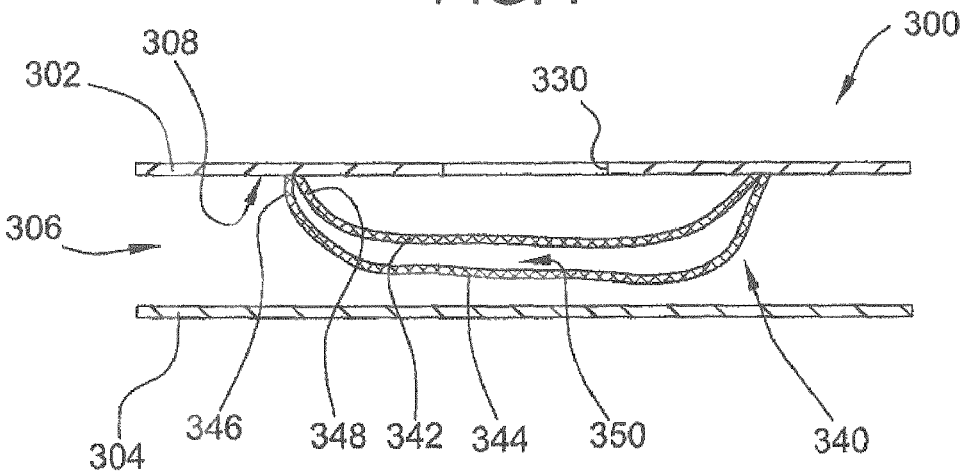
FIG. 7 is a cross-sectional view taken along line A-A of FIG. 1 showing the non-woven material provided as a plurality of layers covering the valve element.

Referring to FIG. 7, there is illustrated another embodiment of the storage bag 300 having first and second side walls designated by reference numerals 302 and 304, respectively, and an aperture 330 disposed through the first sidewall 302 for allowing the removal of air from the interior volume 306. To prevent liquids from accessing the aperture 300, the storage bag 300 incorporates a separation material 340 that, in the illustrated embodiment, is provided as a plurality of layers including at least a first layer 342 and a second layer 344 that are arranged to cover the aperture. The layers may be a non-woven material.

Specifically, in the illustrated embodiments, the first layer 342 and the second layer 344 are loosely attached to each other by their respective first layer peripheral edge 348 and second layer peripheral edge 346. The joined peripheral edges 346, 348 are also attached to the inner surface 308 of the first sidewall 302 such that the first layer 342 is loosely drawn over and covers the aperture 330 and/or valve element 332 and the second layer 344 overlays and covers the first layer 342. Attachment of the first and second peripheral edges 346, 348 and the inner surface 308 can be accomplished by any suitable method including, for example, adhesives and heat sealing.

Because of the loose attachment between the first and second layers 342, 344, the layers form an expandable and collapsible gap or void 350 therebetween. Due to the location of the first and second layers 342, 344 covering the aperture 330, air exhausting from the interior volume must traverse the void 350 to exit the storage bag. It has been found that liquids from the interior volume 306 have difficulty traversing the void 350 and are thereby discouraged from accessing the aperture 330 and/or valve element 332. Moreover, in those embodiments in which the non-woven material used to make the layers demonstrates hydrophobic and/or hydrophilic properties, providing the non-woven material 340 as a plurality of layers increases, in one embodiment, by multiples, the resistance to liquid flow towards the aperture.

In the embodiments in which non-woven material is treated with a low surface energy substance, the void 350 may additionally be used to trap liquids. For example, if the surfaces of both the first and second layers 342, 344 that are directed toward the interior volume 306 are treated with a low surface energy substance, any liquids that manage to traverse the second layer 344 and enter the void 350 are prevented from accessing the aperture 330 by the treated first layer 342. The liquids thereby remain trapped in the void 350.

In other embodiments of the previously described storage bag, the plurality of layers can include additional layers to the first and second layers. However, the number and thickness of the layers should be selected so that the non-woven material does not adversely impact evacuation of air from the interior volume.

Figure 8:
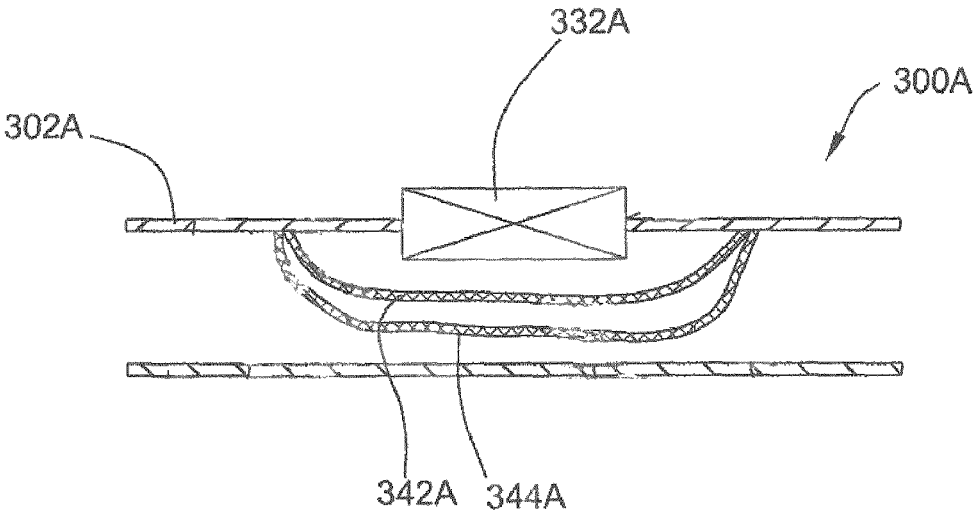
FIG. 8 is a cross-sectional view taken along line A-A of FIG. 1 showing the non-woven material provided as a plurality of layers covering an aperture.

Referring to FIG. 8, the storage bag 300A is similar to storage bag 300, except that the storage bag side wall 302A includes a one-way valve element 332A. As noted at the outset of the detailed description, like reference numbers refer to like features. The storage bag side wall 302A includes a first layer 342A and a second layer 344A. The first and second layers 342A, 344A operate in the same manner as the first and second layers 342, 344 in FIG. 7.

Figure 9:
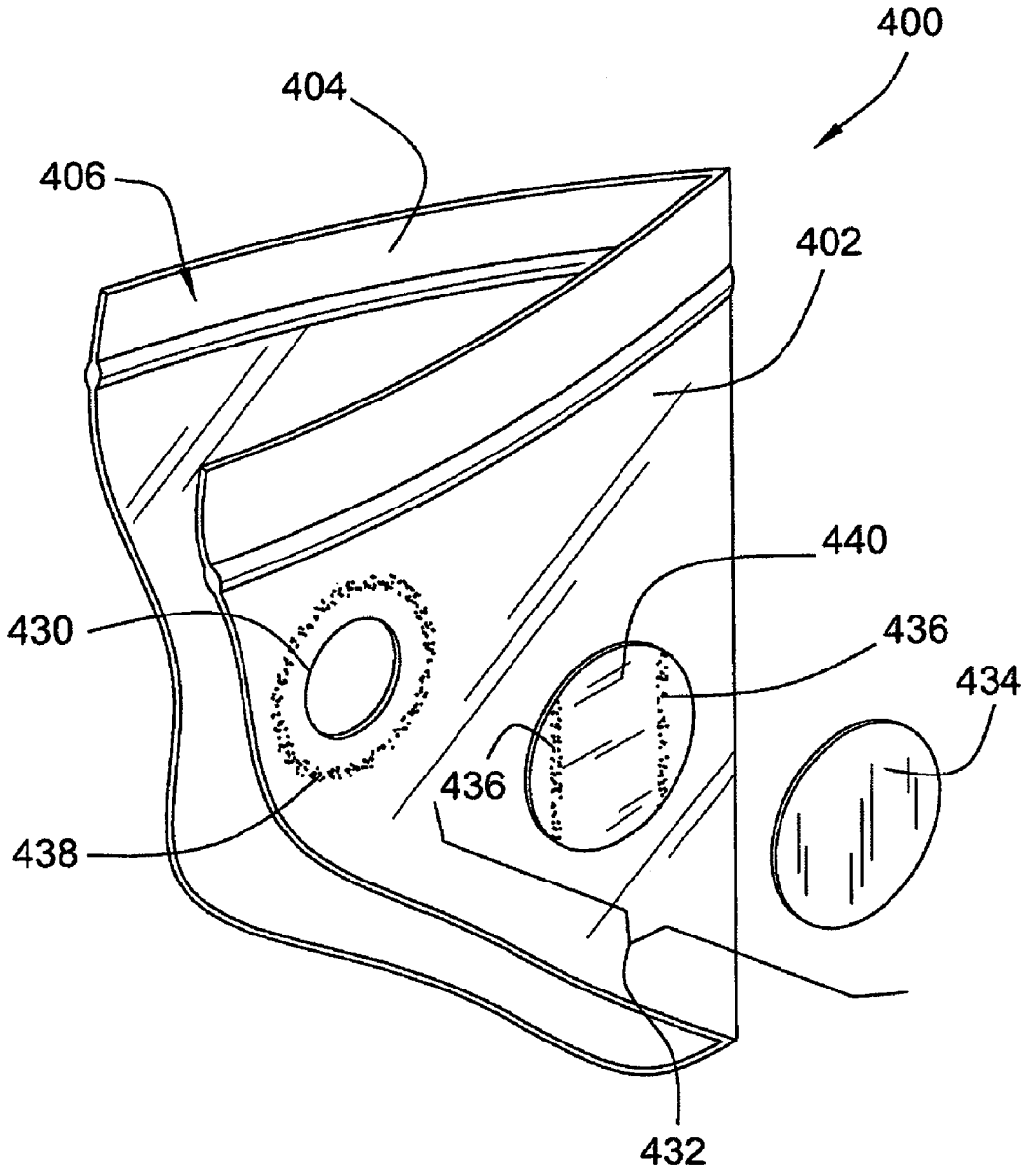
FIG. 9 is a perspective exploded view of a one-way valve element made in part of a non-woven material.

In other embodiments, the separation material can be provided as an operable part of a valve element employed for exhausting air from the interior volume. For example, referring to FIG. 9, there is illustrated a flexible, circular shaped one-way valve element 432 designed to operate in conjunction with an aperture 430 disposed through the first sidewall 402 of the storage bag 400. The valve element 432 includes a separation layer 440 which may be a flexible, thin base layer made of an air permeable, non-woven material. The non-woven base layer 440 can be treated with a low surface energy substance as described above, at least the surface of the base layer directed toward the first sidewall 402. The base layer 440 cooperates with a correspondingly shaped, non-permeable top layer 434 that may be made from a non-permeable thermoplastic film. The top layer 434 is placed over and adhered to the non-woven base layer 440 by two parallel strips of adhesive 436 that extend across the circular base layer thereby forming a channel. The non-woven base layer 440 is then adhered by a ring of adhesive 438 to the flexible bag 400 so as to cover the aperture 430. In other embodiments, instead of adhesive, the valve element components can be attached together by heat sealing.

When the sidewalls 402, 404 of the bag 400 are forcibly compressed together, air from the interior volume 406 will pass through the aperture 430 and through the permeable base layer 440 thereby partially displacing the top layer 434 from the base layer. The air can then pass along the channel formed between the adhesive strips 436 and escape to the environment. It will be appreciated that passing air through the non-woven base layer helps remove liquids from the air. When the force on the sidewalls 402, 404 is released, the resilient top layer 434 will return to its prior configuration adjacent the non-woven base layer 440 thereby covering and sealing the aperture 430. The valve element 432 may also contain a viscous material such as an oil, grease, or lubricant between the two layers in order to prevent air from reentering the bag. In an embodiment, base layer 440 may also be a rigid sheet material.

Figure 10:
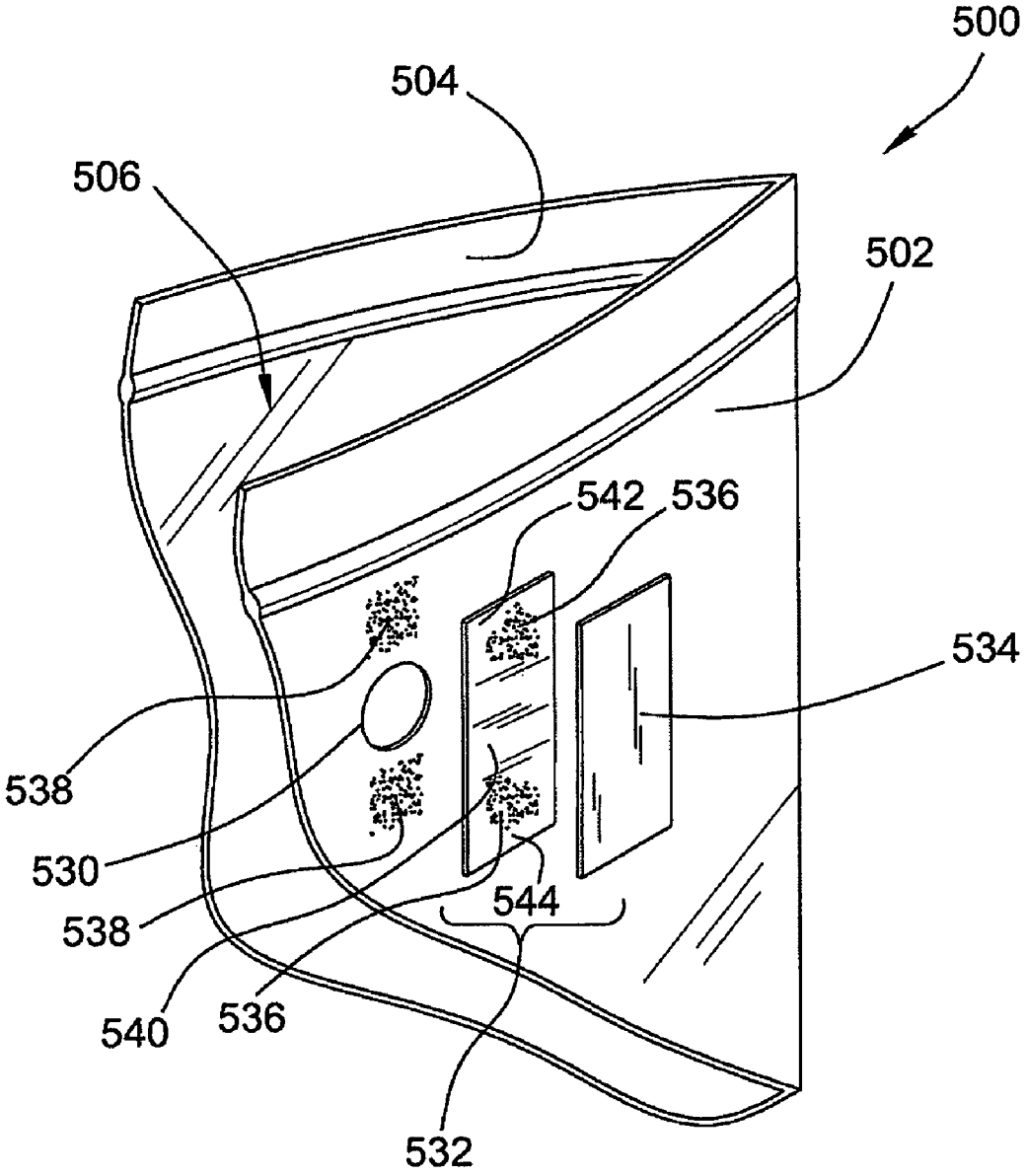
FIG. 10 is a perspective exploded view of another embodiment of a one-way valve element made in part of a non-woven material.

Illustrated in FIG. 10, there is another embodiment of a one-way valve element 532 made partially of a separation material for use with a storage bag 500 having side walls 502 and 504. The valve element includes a rectangular shaped base layer 540 of a separation material which may be an air permeable, non-woven material. The rectangular base layer 540 includes an upper end 542 and a corresponding lower end 544. In various embodiments, the non-woven material may be treated with a low surface energy substance as described above. The base layer 540 operates in conjunction with a similarly shaped top layer 534 that is made of a non-permeable material such as thermoplastic film. The top layer 534 is adhered over the base layer 540 with patches of adhesive 536. The base layer 540 can be attached to the flexible sidewall 502 with additional patches of adhesive 538. In other embodiments, instead of adhesive, the valve element components can be attached by heat sealing. When the bag 500 is compressed, air from the interior volume 506 will pass from the aperture 530 through the permeable base layer 540 thereby displacing the non-permeable top layer 534 and exhaust between the patches of adhesive 536. The treated base layer will help remove liquid from the exhausting air.

Figure 11:
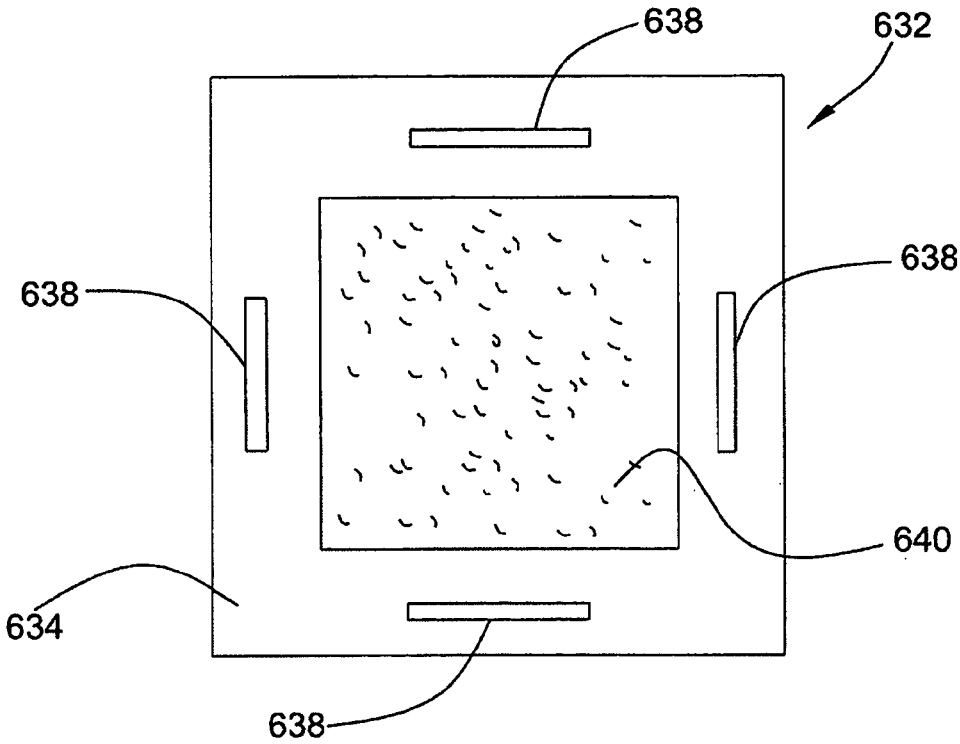
FIG. 11 is a front plan view of another embodiment of a one-way valve element made in part of a non-woven material.
Figure 12:
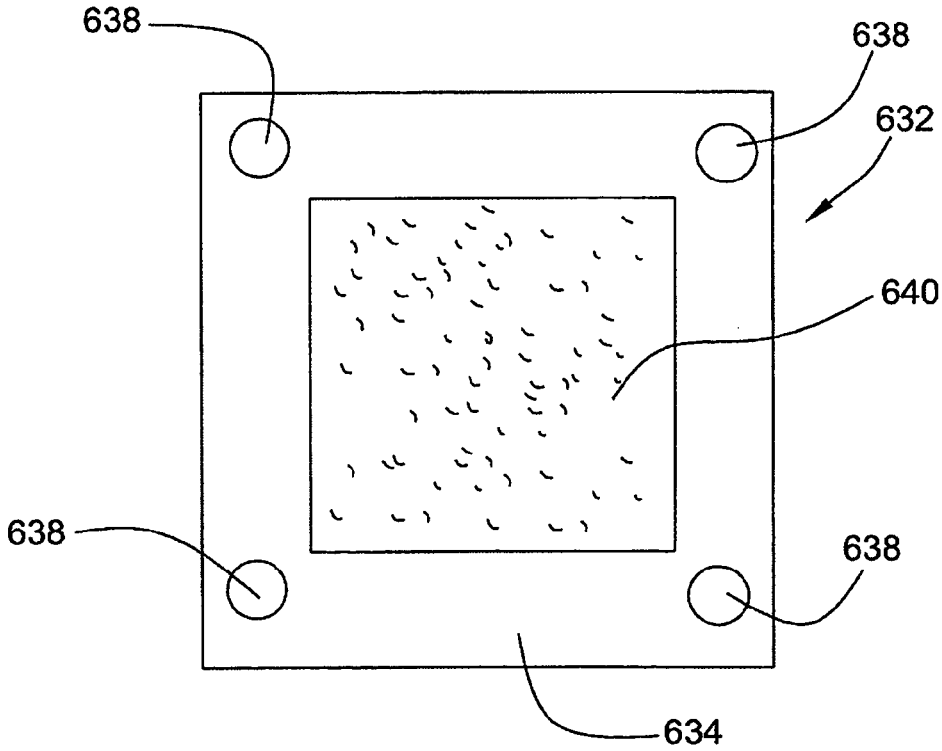
FIG. 12 is a front plan view of another embodiment of a one-way valve element made in part of a non-woven material.

Referring to FIGS. 11 and 12, there are illustrated other embodiments of a one-way valve element 632 made partially of a separation material for use with a storage bag. The illustrated valve element 632 is similar to those disclosed in International patent application PCT/US2003/020478, filed on Jun. 27, 2003, and herein incorporated by reference in its entirety. The valve element 632 includes a square-shaped base layer 640 made of a separation material which may be air-permeable, non-woven material that can be placed over an aperture disposed through the bag sidewall. The non-woven material can be treated with a low surface energy substance as described above. Centered over the top of the non-woven base layer 640 there is placed a slightly larger square-shaped top layer 634 made of a non-permeable material such as a film of thermoplastic material.

In operation, air exhausting from the bag through the permeable, non-woven base layer 640 will encounter and be outwardly dispersed by the non-permeable top layer 634. The non-woven material can demonstrate hydrophobic and/or hydrophilic properties to retain liquids in the bag. To allow the exhausting air to escape from between the base and top layers 634, 640, perforations 638 are disposed through the border-like edges of the top layer. In FIG. 11, the perforations 638 are shaped as straight slits disposed along the side edges while in FIG. 12, the perforations 638 are shaped as circular holes disposed in the corners.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A storage bag comprising:

a pliable sidewall providing an interior volume;

an aperture disposed through the sidewall;

a separation material covering the aperture, the separation material treated with a low surface energy substance selected from the group consisting of silicones, fluorinated fluids, fluoroelastomers, and fluoropolymers;

wherein the separation material is attached to an inner surface of the sidewall about the peripheral edge of the separation material such that the separation material is loosely drawn over the aperture and can hang away from the aperture; and a wholly flexible valve attached to the exterior of the sidewall covering the aperture, wherein the valve comprises a permeable base layer covering the aperture and a top layer covering the base layer, the top layer having curved perforations through the border-like edges of the top layer.

2. A storage bag comprising:

a pliable sidewall providing an interior volume;

an aperture disposed through the sidewall;

a layer of separation material attached to the interior of the sidewall and covering the aperture;

wherein the layer of separation material is attached to an inner surface of the sidewall about the peripheral edge of the separation material such that the separation material is loosely drawn over the aperture and can hang away from the aperture; and wherein the layer of separation material provides an expandable and collapsible void therebetween;

a wholly flexible valve attached to the exterior of the sidewall covering the aperture, wherein the valve comprises a base layer covering the aperture and a top layer covering the base layer, the top layer having perforations through the border-like edges of the top layer wherein the layer of separation material is not attached to the valve.

3. The storage bag of claim 2, wherein the separation material is treated with a low surface energy substance selected from the group consisting of silicones, fluorinated fluids, fluoroelastomers, and fluoropolymers.

4. The storage bag of claim 2, wherein the separation material is a non-woven material.

5. The storage bag of claim 1, wherein the separation material is a non-woven material.

6. A storage bag comprising:

a first pliable sidewall;

a second pliable sidewall overlying and joined to the first sidewall to provide an interior volume;

a one-way valve element attached to the first sidewall and communicating with the interior volume;

a permeable separation material covering an aperture on the first sidewall;

wherein the separation material is located in the interior volume and attached to the inner surface of the first sidewall continuously about the peripheral edge of the separation material such that the separation material is loosely drawn over the aperture and can hang away from the aperture; and wherein the valve element is placed over the exterior surface of the aperture in the first sidewall and the valve element consists of an intermediate permeable base layer and an outer top layer having multiple slits and the valve element is operative to evacuate latent air trapped in the interior volume to outside environment and prevent ingress of environmental air back through the aperture to the interior volume.

7. The storage bag of claim 1, wherein the separation material is treated with a low surface energy substance.

8. The storage bag of claim 7, wherein the low surface energy substance is selected from the group consisting of silicones, fluorinated fluids, fluoroelastomers, and fluoropolymers.

9. The storage bag of claim 1, wherein the separation material is provided as a plurality of layers.

10. The storage bag of claim 9, wherein the plurality of layers includes a first layer covering the aperture and a second layer covering the first layer.

11. The storage bag of claim 10, wherein the first and second layers provide an expandable and collapsible void therebetween.

12. The storage bag of claim 1, wherein the separation material is a non-woven material.

13. The storage bag of claim 12, wherein the non-woven material is made from fine fibers of 30 microns or less.

* * * * *